US005871301A

United States Patent [19]

Skelton

[11] Patent Number: 5,871,301

[45] Date of Patent: Feb. 16, 1999

[54] REVERSIBLE GRADE ALIGNMENT SYSTEM

[76] Inventor: Gene Skelton, 2375 Claxton Loop, Batesville, Ark. 72501

[21] Appl. No.: 854,732

[22] Filed: May 12, 1997

[51] Int. Cl.[6] ..... E01C 23/07

[52] U.S. Cl. ..... 404/84.2; 404/84.1

[58] Field of Search ..... 404/84.05, 84.1, 404/84.2, 84.8; 33/792; 7/163, 164

[56] References Cited

U.S. PATENT DOCUMENTS

| | | | |
|---|---|---|---|
| 2,844,882 | 10/1958 | Earley et al. . | |
| 2,907,398 | 10/1959 | Guntert et al. . | |
| 3,249,026 | 5/1966 | Curlett et al. . | |
| 3,334,560 | 8/1967 | Long et al. | 404/84.2 |
| 3,511,949 | 5/1970 | Hanson . | |
| 3,514,630 | 5/1970 | Steele et al. . | |
| 3,540,360 | 11/1970 | Snow et al. . | |
| 3,635,131 | 1/1972 | Larsen et al. | 404/84.1 |
| 3,637,026 | 1/1972 | Snow . | |
| 3,791,753 | 2/1974 | Rymsa . | |
| 3,807,887 | 4/1974 | Tate | 404/84.2 |
| 3,999,314 | 12/1976 | Miller et al. | 404/84.2 X |
| 4,270,801 | 6/1981 | Swisher et al. | 404/84.2 X |
| 4,403,889 | 9/1983 | Gillotti . | |
| 4,861,191 | 8/1989 | Smith et al. | 404/104 |
| 4,948,292 | 8/1990 | Haven et al. . | |
| 5,599,134 | 2/1997 | Macku et al. | 404/84.2 X |

FOREIGN PATENT DOCUMENTS

| | | | |
|---|---|---|---|
| 584016 | 10/1958 | Italy | 404/84.1 |

*Primary Examiner*—Tamara L. Graysay
*Assistant Examiner*—Sunil Singh
*Attorney, Agent, or Firm*—Stephen D. Carver

[57] ABSTRACT

A reversible alignment system comprising an indicator assembly supported by a mounting assembly that uses conventional reference guides such as a string line or hard surface adjacent the construction site to ensure proper tool orientation for construction vehicles. The indicator assembly comprises a follower, an offset counterweight and a rotary dial supported by a mounting plate. The follower comprises a probe or wheel that moves along the reference guide during vehicle movement. The follower attaches to a linkage bar that connects to a counterweight that keeps the follower against the reference as the vehicle traverses the site. The weight is slightly offset from the follower to dampen vibrations during movement. A pointer secured to the linkage traverses a rotary dial visible to the operator during use. The rotary dial comprises an arcuate gauge with a spaced apart left marker and right marker traversed by the pointer. As the follower moves upwardly or downwardly, the pointer moves correspondingly along the gauge to alert the operator. A mounting plate secures the indicator assembly to the mounting assembly. The mounting assembly comprises a jack connected to a bracket by a standoff. The jack permits the operator to quickly raise or lower the indicator. The mounting assembly can be adjusted at several points so that the follower is properly positioned. The indicator assembly can be easily reversed and moved to the right side of the motor grader by simply flipping the assembly over and reading the pointer against the right side marker.

13 Claims, 11 Drawing Sheets

REVERSIBLE GRADE ALIGNMENT SYSTEM

BACKGROUND OF THE INVENTION

1. Field of the Invention

The present invention relates generally to grade alignment devices used in construction. More particularly, the present invention relates to a reversible alignment system for motor grader blades and the like. Known prior art may be found in U.S. Classes 94, 172, 404 and the various subclasses thereunder.

2. Description of the Prior Art

As will be recognized by those skilled in the art, construction at large projects is often difficult and requires special considerations. In particular, it is often difficult to build roads and the like that conform to established specifications. To assist those working on such projects, string lines or other reference points are normally erected at the site.

However, such references are often difficult for operators of large, earth-moving equipment such as motor graders to rely upon during normal operations. Several complicated prior art devices have been proposed to address this issue. For example, U.S. Pat. No. 3,514,630 issued to Steele shows an add-on leveling unit which is an accessory to a paving machine that provides a reference to the observer. Another, U.S. Pat. No. 3,637,026, shows automatic valves, etc., that are actuated by a probe that follows a conventional string line. This device uses numerous probes all at once and provides complex differential elevation control.

U.S. Pat. No. 3,791,753, shows an "elevation sensing device" 77 in FIGS. 7 & 8 of the drawings that is also discussed in Columns 5, lines 45–55. U.S. Pat. No. 4,403,889, shows an optical way of using a string line for a reference. It provides a visible warning to the operator when the operating the device. U.S. Pat. No. 4,948,292, uses a string line sensing system 80 in combination with a projecting ball at one end that actuates automatic apparatuses. Another interesting device is shown in U.S. Pat. No. 3,540,360, with a the string line apparatus 100 that includes the visible elements 108 and 112 that operates mechanical devices. U.S. Pat. No. 2,844,882, shows an automatic level control that references the string line as well. U.S. Pat. Nos. 3,249,026, 3,511,949 and 2,907,398 all show similar devices.

These devices are all somewhat complicated and they are generally designed to be permanently installed on the vehicle. Moreover, since some require special adaptation and the like, they are often difficult to retrofit to existing machinery without significant modifications. Such modifications often hamper the equipment's normal use or otherwise prevent its convenient use. Consequently, the known prior art fails to provide an economical and efficient, retrofittable guidance system for earth-moving equipment that maintains the equipment's original operational parameters.

A desirable system should enable the operator to easily comply with construction specifications by using conventional reference guides such as string lines or the like. Furthermore, it should enable the operator to fully utilize the machinery as intended without hampering the machinery during normal operations. Preferably, such an improved system would require minimal alterations to the original equipment to preserve the equipment's operational parameters.

One important feature lacking in the known prior art is a quickly reversible alignment system that would enable the operator of a motor grader or the like to utilize both the left and right hand sides of the vehicle equally. While some prior art devices employ structure that enables both sides of the vehicle to be used, they generally entail doubling the working structures involved with the device. Such duplication entails larger initial expenses as well as higher maintenance and more frequent down time caused from breakdowns. A better approach would be to provide an easily reversible system that required minimal set-up time and little operator training to employ. Such a system would cut initial costs while decreasing maintenance costs and down time during use.

Thus, a quickly reversible alignment system that permitted convenient transfer from the left to the right side of the vehicle would be desirable. A system that required minimal tools and operator training would also be beneficial.

Summary of the Invention

My reversible alignment system overcomes the above discussed problems with prior art devices. It is placed on the blade or active tool of conventional earth-moving construction equipment to align and maintain the blade's orientation during construction work. Moreover, it can be easily reversed to fit either side of the vehicle so that one vehicle can quickly work in either direction of travel.

My system is used with heavy earth-moving equipment to maintain a selected grade during operation at a construction site. At most construction sites, a string line establishes a reference for the measurements of grades and the like. My system may alternatively employ a hard surface, such as concrete surface immediately adjacent the construction site for a reference. Preferably, the system uses the string line or surface to guide the operator during grading and the like.

In the preferred embodiment, the alignment system is installed on the blade of a conventional motor grader. Of course, the system could be used with the active tool or blade of other types of equipment as well. The system permits the operator to constantly monitor the blade relative to the string line or similar reference so that a desired blade orientation can be maintained. Consequently, desirable grades can be more quickly achieved by the operator with less error.

The alignment system comprises an indicator assembly supported by a mounting assembly. The indicator assembly comprises a follower, an offset counterweight and a rotary dial, all supported by a mounting plate. The follower preferably comprises a resilient, elongated hollow probe. In the alternative embodiment, a wheel is employed. The probe is typically spring-loaded internally while wheel is spring-loaded externally. In use, probe moves along the underside of string as the vehicle moves. The wheel moves along the surface as the vehicle moves. Both the preferred probe and the alternative wheel attach to a linking bar that connects to the counterweight.

The linkage bar couples the follower to the counterweight. The counterweight keeps the follower against the line or surface as the vehicle traverses the site. The counterweight comprises an elongated elbow with spaced apart, threaded ends. One end penetrates a hole in bar and is secured thereto. A pair of intermediate pillow blocks secure the counterweight and follower to a mounting plate. A pair of adjustable locking collars secure the elbow in the pillow blocks. The other elbow end secures a threaded doughnut weight. Preferably, the weight is so slightly offset from horizontal with respect to the follower to dampen vibrations encountered during vehicle movement.

A pointer secures to the linkage bar adjacent the elbow. The pointer traverses a rotary dial read by the operator during use. The rotary dial comprises an arcuate gauge with spaced apart left marker and right marker traversed by the pointer. A pointer moves along gauge during use so that the operator may adjust the blade as necessary to maintain proper orientation with respect to the string or surface. As the follower moves upwardly or downwardly, the pointer moves correspondingly along the gauge to alert the operator.

A mounting plate secures the follower, offset weight and rotary dial to the mounting assembly. The mounting assembly secures the indicator assembly to the blade or tool. The assembly comprises a telescoping jack connected to a reinforced elbow bracket by an adjustable standoff. The jack comprises a hollow upper sleeve and a lower column that permit the operator to quickly raise or lower indicator assembly as necessary. A locking set screw secures the column once positioned properly. The jack is adjustably secured to standoff and to the reinforced elbow to permit selective positioning of the jack relative to blade. The standoff comprises an elongated central body penetrated by the elbow. A set screw permits the body to rotate and/or move vertically along the upper elbow arm. The bracket mounts directly on blade via spaced apart posts that are permanently secured to blade by welding or other conventional methods. The elbow bracket comprises the aforementioned upper arm and a lower arm that penetrates both posts to secured the bracket thereto with set screws. The bracket may thus be pivoted or moved horizontally along the blade as necessary.

Preferably, the mounting assembly can be adjusted at several points so that the indicator and follower are properly positioned. The receiver may be pivoted about its mounting bolt or the jack column may be quickly adjusted upwardly and downwardly by operator manipulation of the handle. The jack may also be moved upwardly or downwardly by manipulating its u-bolts. The standoff may be rotated about the upper elbow arm and it may also be raised and lowered as well. The bracket can itself be pivoted in its posts or moved laterally as well.

The indicator assembly can be easily reversed and moved to the right side of the motor grader by simply flipping the assembly over. As a result, the linkage bar moves along the gauge to the right side marker. Of course, the arm must be rotated appropriately. Either the mounting assembly must be disconnected from the blade or another mounting assembly must be installed on the right side of grader. If the mounting assembly is moved as well, the standoff must also be rotated 180 degrees.

In use, the operator watches the pointer to ensure that it remains aligned with the appropriate marker (either the left or right marker on the rotary gauge). As the probe moves upwardly or downwardly, the pointer moves along the gauge correspondingly and the operator must change the blade orientation until the pointer again returns to the marker. Thus, the system permits the operator to quickly and efficiently establish desired grades during construction work.

Thus, a primary object of the present invention is to provide an easily reversible alignment system for construction equipment.

Another basic object of the present invention is to provide a highly visible, efficient manual alignment system that may be easily employed with minimal operator training.

A related object of the present invention is to increase the speed of producing desirable grades at construction sites while minimizing working time.

Another object of the present invention is to provide an efficient system that may be quickly transferred from the left side to the right side of a motor grader blade with minimal tools.

A related object of the present invention is to provide a system that has few moving parts to ensure reliable operation and low maintenance costs.

Yet another basic object of the present invention is to provide a alignment system that permits an operator to fully utilize a conventional string guide or the like.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 10 is a rear elevational view of the indicator assembly;

DETAILED DESCRIPTION

Figure 1:
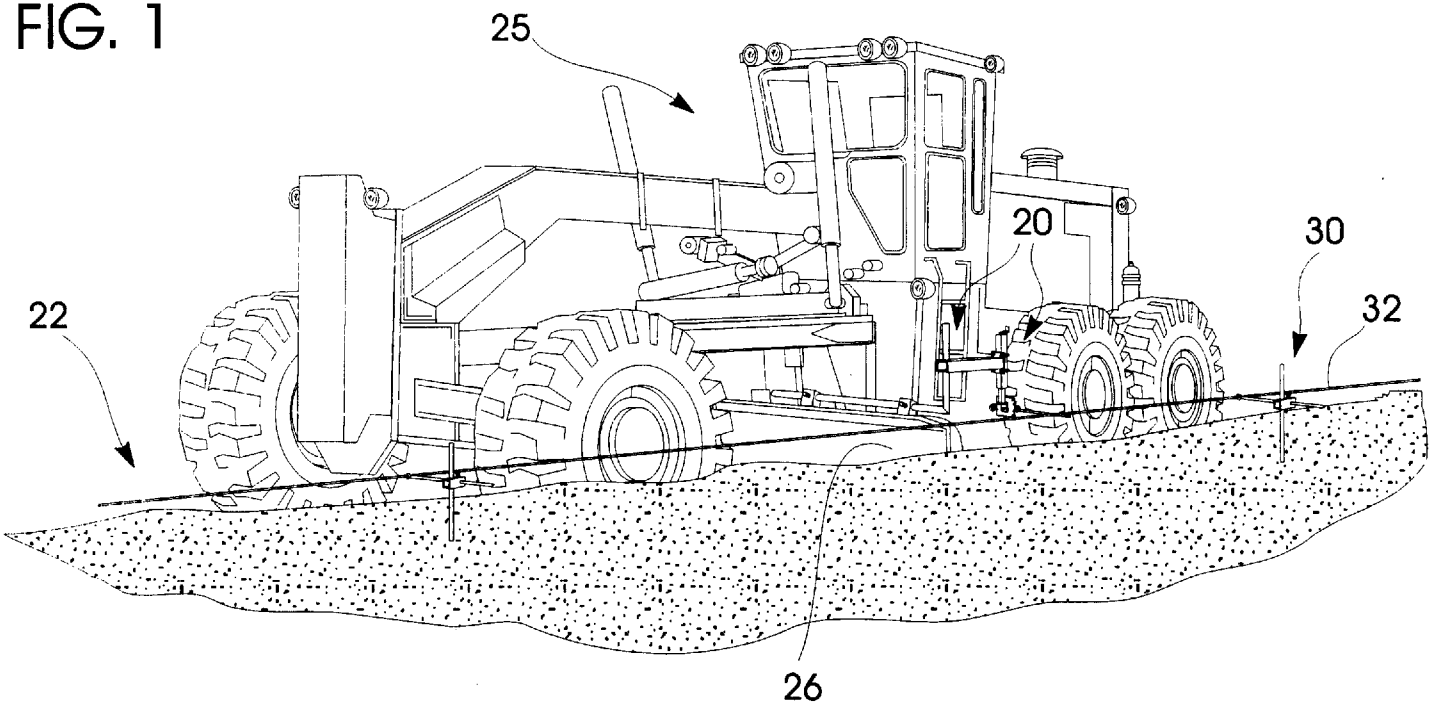
FIG. 1 is an environmental view showing my reversible grade alignment system in use with a motor grader and installed on the operator's left-hand side of the grader.
Figure 2:
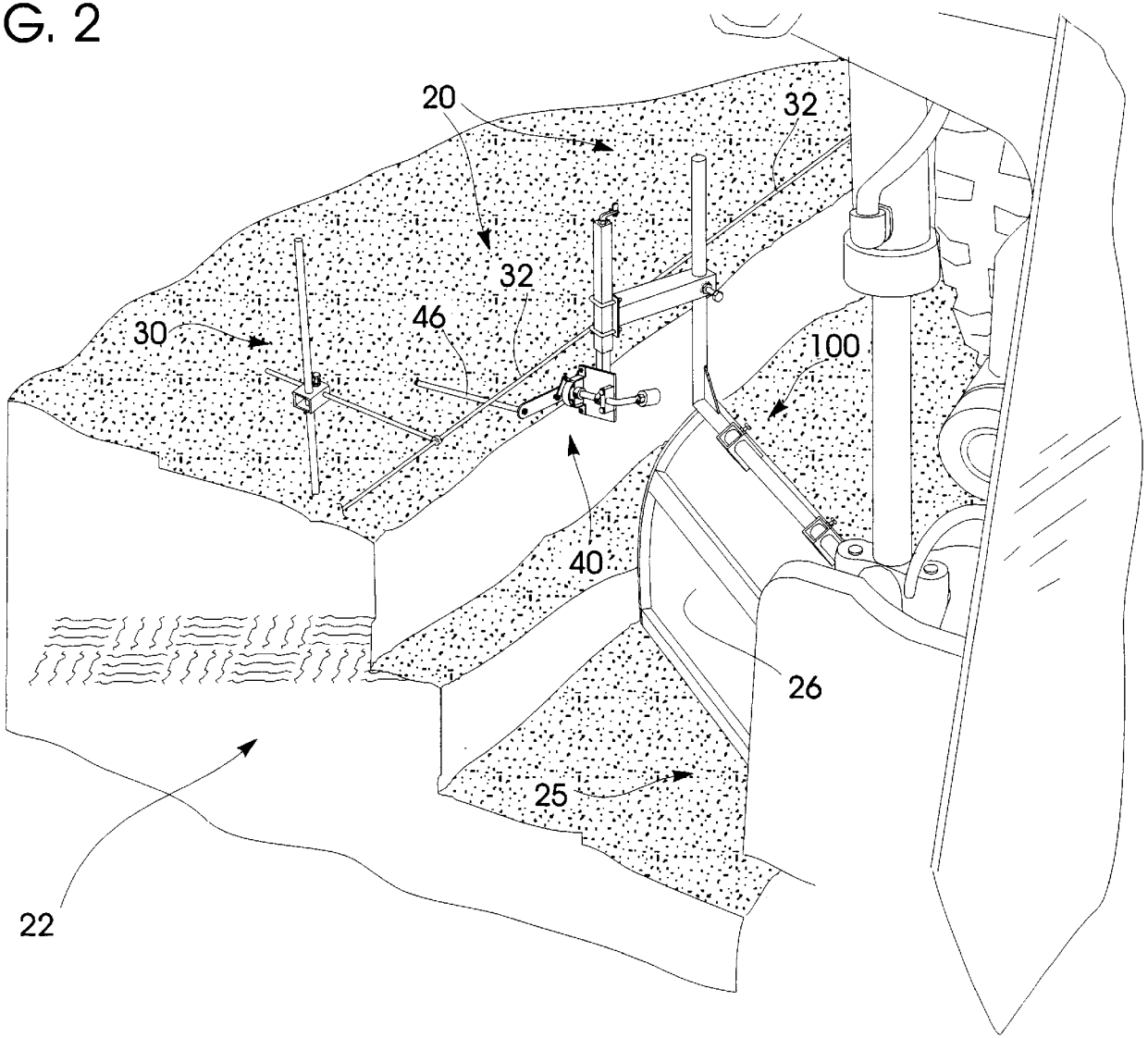
FIG. 2 is an environmental view showing the invention of FIG. 1 as seen by the operator.
Figure 3:
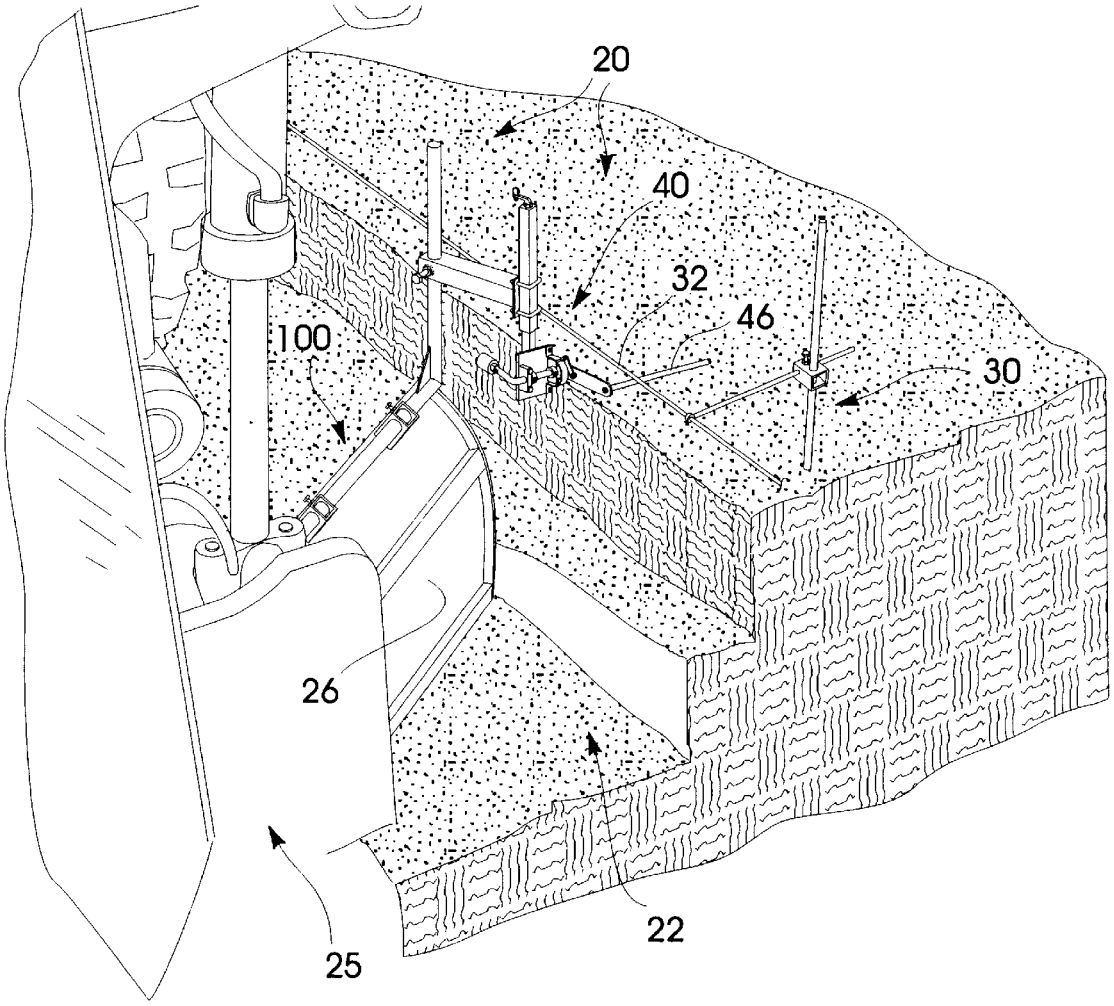
FIG. 3 is an environmental view similar to FIG. 2 but showing the invention reversed and installed on the right-hand side of the grader.
Figure 4:
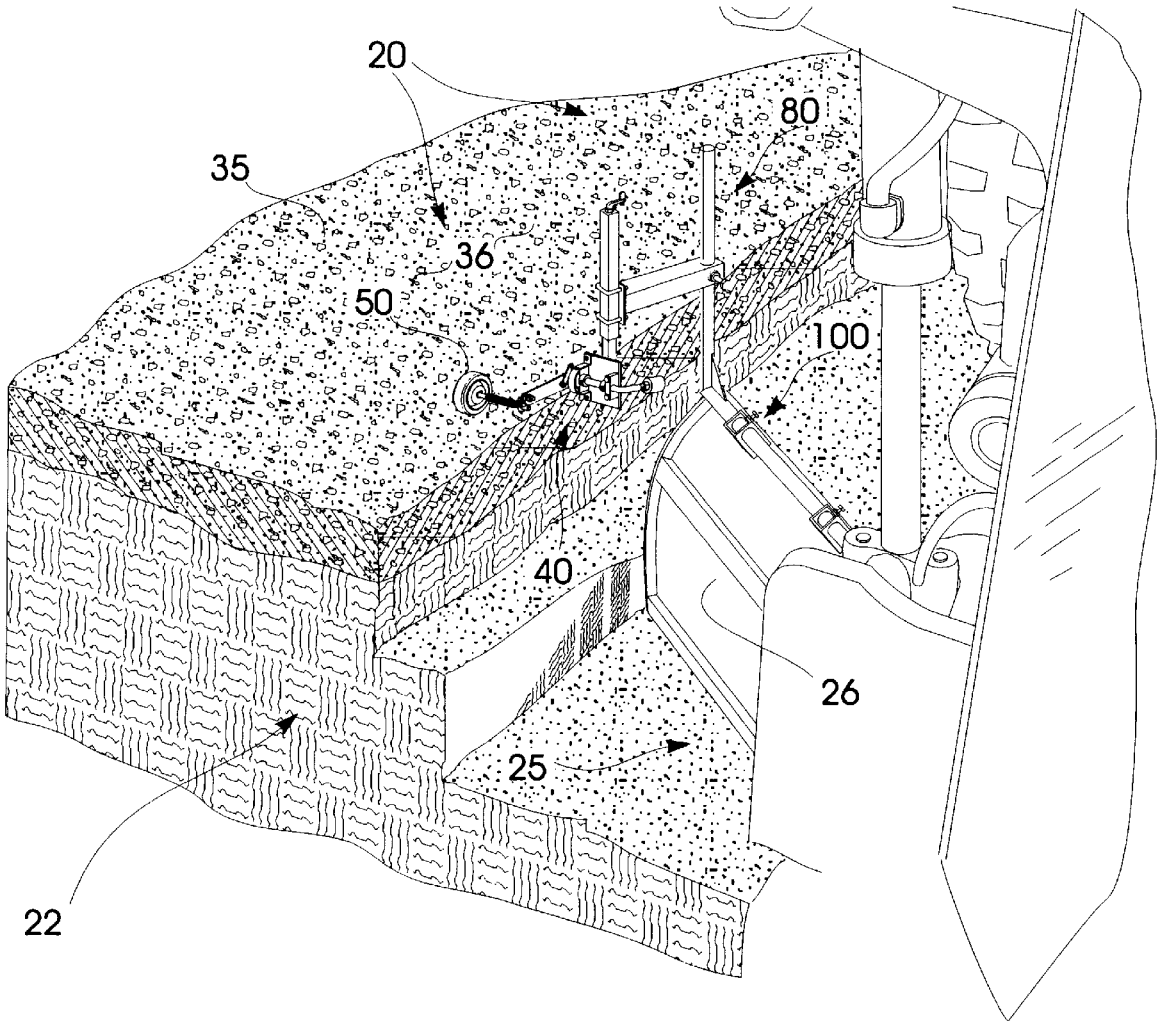
FIG. 4 is an environmental view similar to FIG. 2 but showing an alternative follower

Referring more specifically to the drawings, my improved reversible grade alignment system is generally indicated by reference numeral 20 in FIGS. 1–15. The system 20 is used with large earth-moving equipment to maintain a selected grade during operations at a construction site 22. At most construction sites, a string line 30 is used as a reference guide for the measurements of grades and the like (FIGS. 1–3) to ensure the resultant work conforms to construction specifications. In the alternative embodiment shown in FIG. 4, system 20 uses a hard surface, such as concrete surface 35 immediately adjacent the construction site as a reference guide. In other words, the system 20 uses the string line 30 or surface 35 to guide the operator during grading or other leveling work.

In FIGS. 1–4, the system 20 has been installed on the blade 26 of a conventional motor grader 25. Of course, the system 20 could be used with the active tool or blade of other types of equipment as well. System 20 permits the operator to constantly monitor the blade 26 relative to the string line 30 or similar reference so that a desired blade orientation can be maintained. Consequently, desirable grades can be more quickly achieved by the operator with less error.

Figure 5:
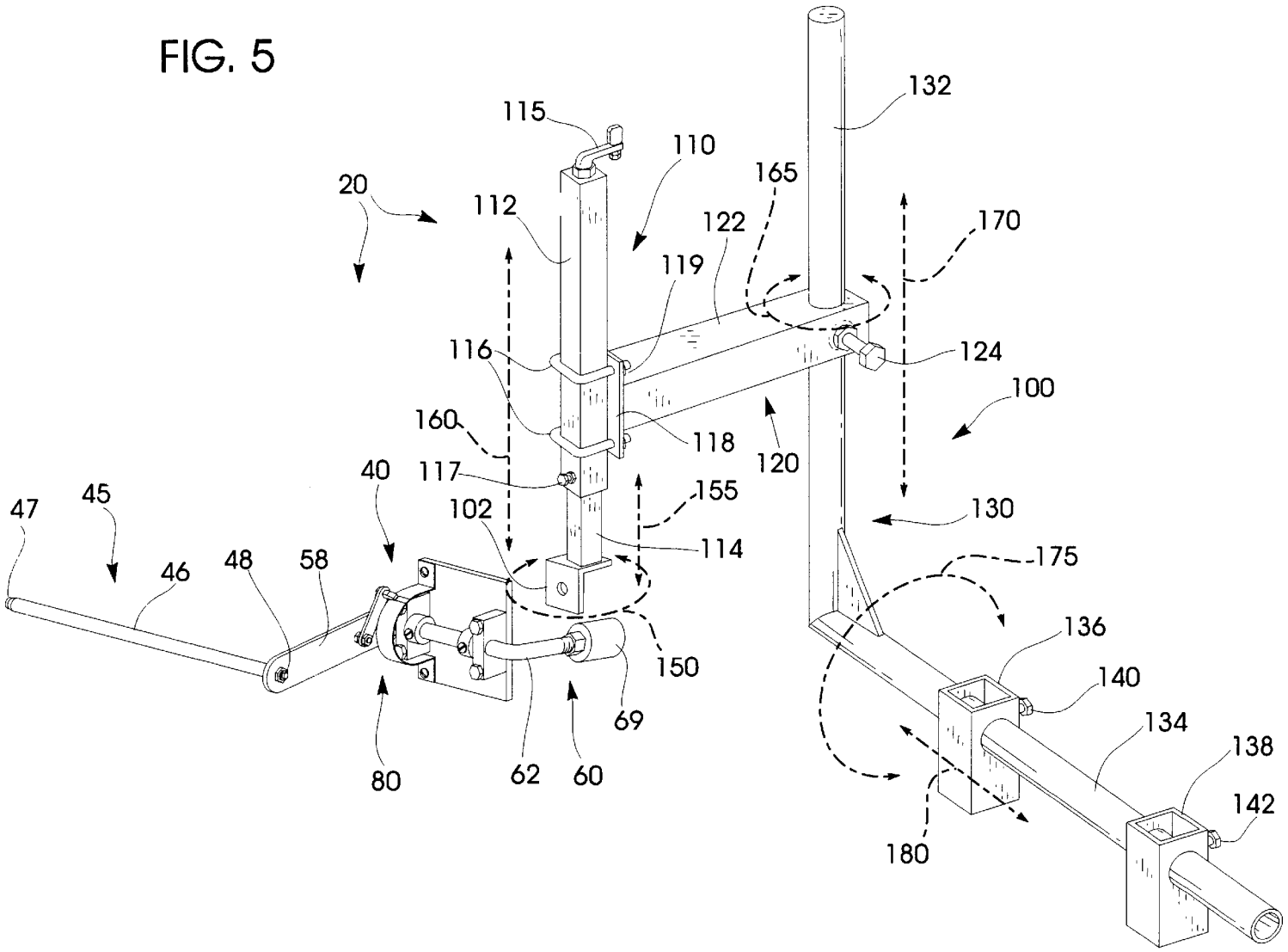
FIG. 5 is an isometric view showing the mounting and indicator assemblies.
Figure 6:
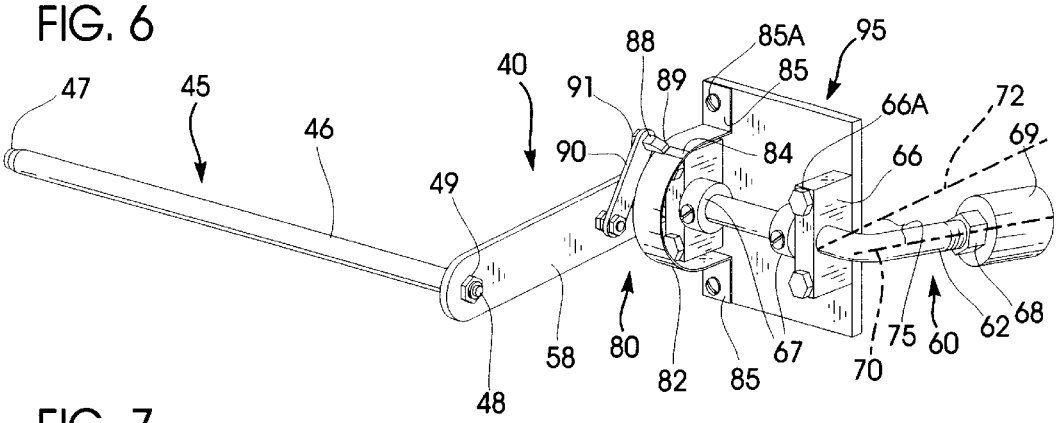
FIG. 6 is an isometric view showing the indicator assembly.

Alignment system 20 comprises an indicator assembly 40 supported by a mounting assembly 100 (FIG. 5). The indicator assembly 40 comprises a follower 45, an offset counterweight 60 and a rotary dial 80, all supported by a mounting plate 95 (FIGS. 6–9).

The follower 45 extends beyond the vehicle periphery during operation so that a portion of the follower runs against the guide (either line 32 or surface 36) during vehicle movement. Follower 45 preferably comprises a conventional elongated hollow probe 46 with a terminus 47 that runs under string 32. In the alternative embodiment, a wheel 50 is employed that runs over surface 22. Probe 46 is typically spring-loaded internally while wheel 50 is spring-loaded externally by spring 52. In use, the probe terminus 47 moves along the underside of string 32 as the vehicle 25 traverses site 22. With the alternative embodiment, wheel 50 moves along the surface 36 as the vehicle 25 traverses site 22.

Probe 46 uses a brightly colored exterior terminus 47 to enable the operator to see the end of probe 46 to keep it appropriately positioned on line 32. Probe 46 attaches to a linking bar 58 via an interior stud 48 and bolt 49. Wheel 50 spins on split axle 51A, 51B. Axles 51A, 51B are coupled together via covering spring 52. Axles 51A, 51B are attached to bar 58 by a mounting elbow 53 and corresponding bolts 54, 56 and nuts 55, 57.

Linkage bar 58 pivotally couples the follower 45 to the counterweight 60. Counterweight 60 keeps the follower 45 against the line 32 or surface 36 as the vehicle 25 traverses site 22. Counterweight 60 comprises an elongated elbow 62 with threaded ends 63, 64. End 63 penetrates a hole 59 in bar 58 and is secured thereto by nuts 65. A pair of intermediate pillow blocks 66 secure the counterweight 60 and follower 45 to mounting plate 95. Both pillow blocks 66 are centrally penetrated by elbow 62, which pivots therein. Pillow blocks 66 secure to mounting plate holes 96 via bolts 66A. A pair of adjustable locking collars 67 secure elbow 62 in pillow blocks 66. Set screws 67A permit collar adjustment to move elbow 62 laterally. The other elbow end 64 secures a threaded doughnut weight 69 and locking nut 68.

It has been found that the weight 69 should be slightly offset from horizontal with respect to the follower 45 to dampen vibrations encountered during vehicle movement. Consequently, the axis of counterweight 60 (represented by line 70 in FIGS. 6 and 7) is preferably offset from the axis of follower 45 (represented by line 72 in FIGS. 6 and 7) between 3 and 6 degrees, most preferably 4.5 degrees, to form a dampening angle 75. Dampening angle 75 forces follower 45 to maintain guiding contact during operation and produces more consistent readings with rotary dial 80. The dampening angle 75 may be modified if necessary by adjusting the angle formed by the junction of the elbow 62 with linkage 58 at end 63 (by loosening nuts 65 and repositioning the elbow relative to the linkage).

The rotary dial 80 is visible to the operator during use so that the blade orientation can be constantly monitored and/or corrected. Rotary dial 80 comprises an arcuate gauge 82 with spaced apart left marker 84 and right marker 86 traversed by a pointer 88. Spaced apart flat tabs 83 bound gauge 82 with holes 85 and corresponding bolts 85A and nuts 85B that mount the dial to mounting plate 95 via holes 97. A highly visible pointer 88 registers on gauge 82 during to facilitate operator blade monitoring. Thus, the operator may easily monitor the blade and adjust it as necessary to maintain proper orientation with respect to the reference guide (i.e., string 32 or surface 36).

Pointer 88 is mounted on linkage 58 by arm 90. Pointer 88 comprises a threaded stud with a highly visible terminal tip 89 so that the operator may easily read the pointer registration on gauge 82. Ann 90 is penetrated by pointer 88, which is secured thereto by a nut 91. Arm 90 secures to linkage 58 via bolt 92 and nuts 93. Thus, as follower 45 moves upwardly or downwardly, pointer 88 moves correspondingly along gauge 82 to alert the operator.

Mounting plate 95 secures the follower 45, offset weight 60 and rotary dial 80 to the mounting assembly 100. A rear stud 98 extends from plate 95 into a receiver 102 and is secured thereto via nut 99.

Mounting assembly 100 secures the indicator assembly 40 to the blade 26. Assembly 100 comprises a telescoping jack 110 connected to a bracket 130 by an adjustable standoff 120.

Jack 110 comprises a hollow upper sleeve 112 and a lower column 114. Jack 110 permits the operator to quickly raise or lower indicator assembly 40 as necessary. Column 114 is telescopically received by sleeve 112 and moves in response to operator manipulation of handle 115. Of course, an electric motor could also be used. A locking set screw 117 secures the column 114 once positioned properly. Column 114 supports receiver 102 via a conventional bolt (not shown) and indicator assembly 40 thereby. Sleeve 112 is secured to standoff 120 by two spaced apart u-bolts 116 and corresponding plate 118 and nuts 119.

Standoff 120 adjustably secures jack 110 to a reinforced elbow bracket 130 to permit selective positioning of the jack 110 relative to blade 26. Standoff 120 comprises an elongated central body 122. Body 122 secures jack 110 at one end and it is penetrated by elbow 130 at the other. A set screw 124 permits the body 122 to rotate and/or move vertically along the upper elbow arm 132.

The reinforced elbow bracket 130 mounts directly on blade 26 via posts 136, 138 that are permanently secured to blade 26 by welding or the like. Bracket 130 comprises the aforementioned upper arm 132 and a lower arm 134. Lower arm 134 penetrates both posts 136 and 138 and is secured thereto by set screws 140, 142. Arm 134 may thus be pivoted or moved horizontally along blade 26 as necessary to properly position bracket 130.

As can best be seen in FIG. 5, the mounting assembly 100 can be adjusted at several points so that indicator 40 and follower 45 are properly positioned against string 32 or surface 36. As indicated by arrow 150, the receiver 102 may be pivoted about its mounting bolt. Furthermore, the jack column 114 is quickly adjustable upwardly and downwardly as indicated by arrow 155 by operator manipulation of handle 115. The jack 110 may also be moved upwardly or downwardly as indicated by arrow 160 by manipulating u-bolts 116. The standoff may be rotated about arm 132 as indicated by arrow 165 and it may also be raised and lowered on arm 132 as indicated by arrow 160. The bracket 130 can also be pivoted in posts 136 and 138 as indicated by arrow 175 and moved laterally as indicated by arrow 180.

Figure 7:
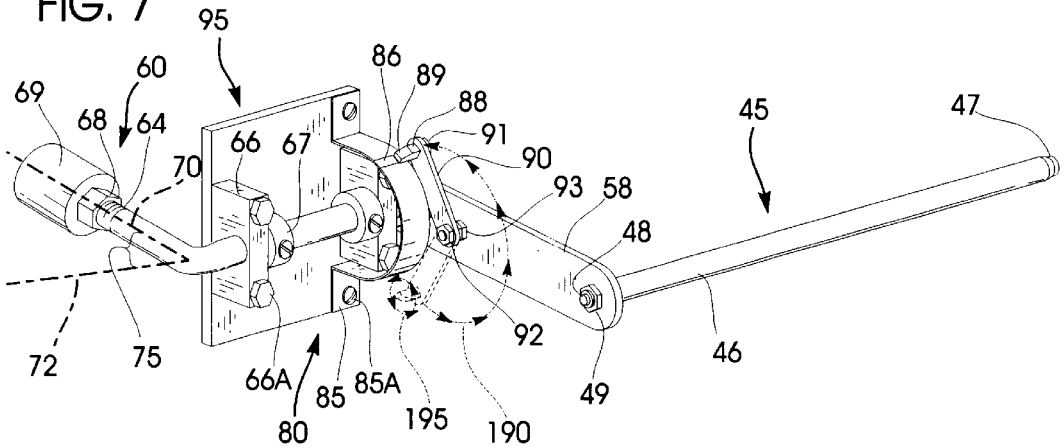
FIG. 7 is an isometric view similar to FIG. 6 but showing the indicator assembly in the reversed configuration.
Figure 8:
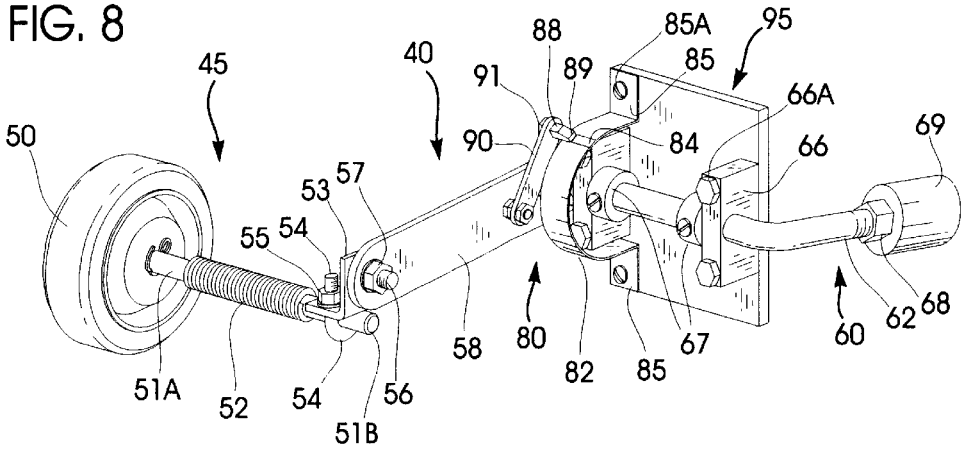
FIG. 8 is an isometric view similar to FIG. 6 but showing the alternative follower.
Figure 9:
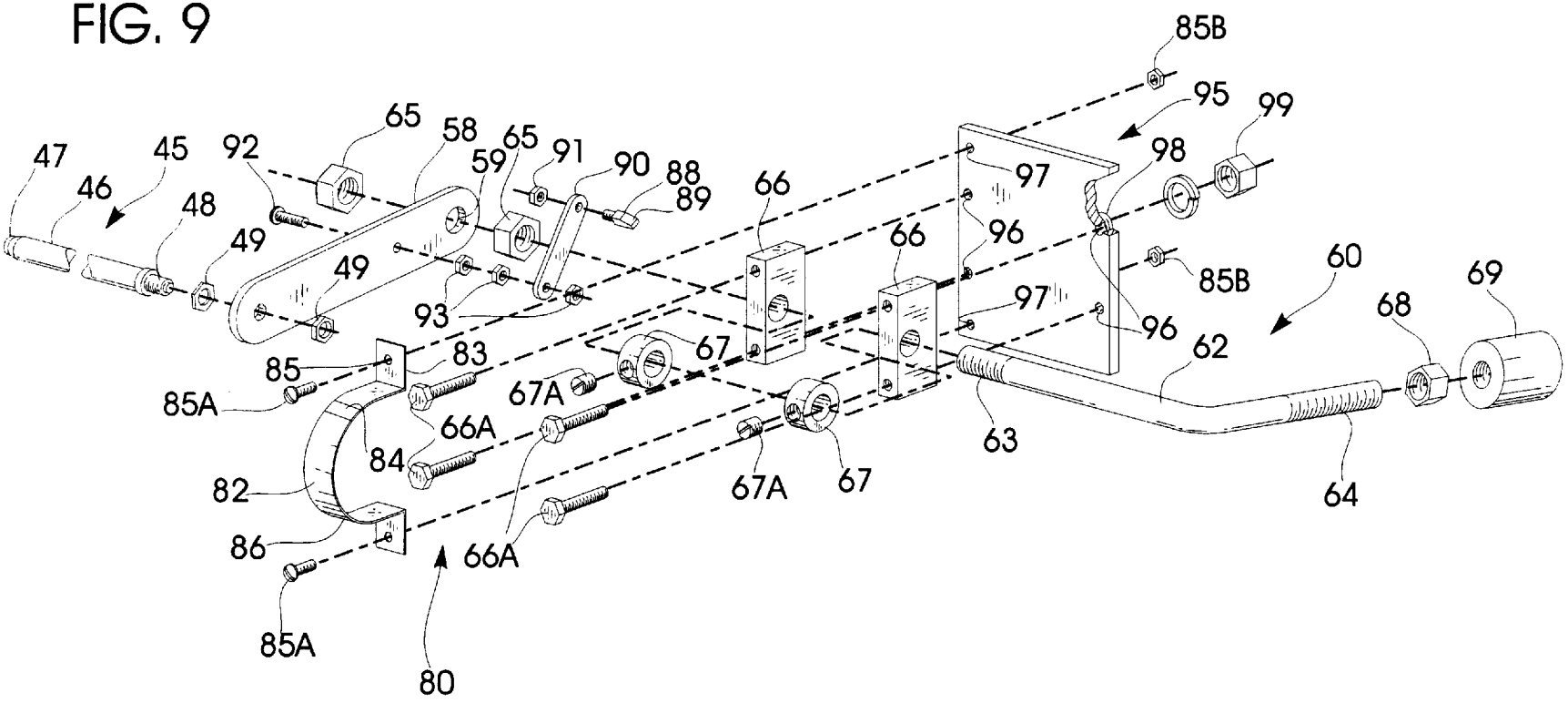
FIG. 9 is an exploded isometric view of the indicator assembly.
Figure 10:
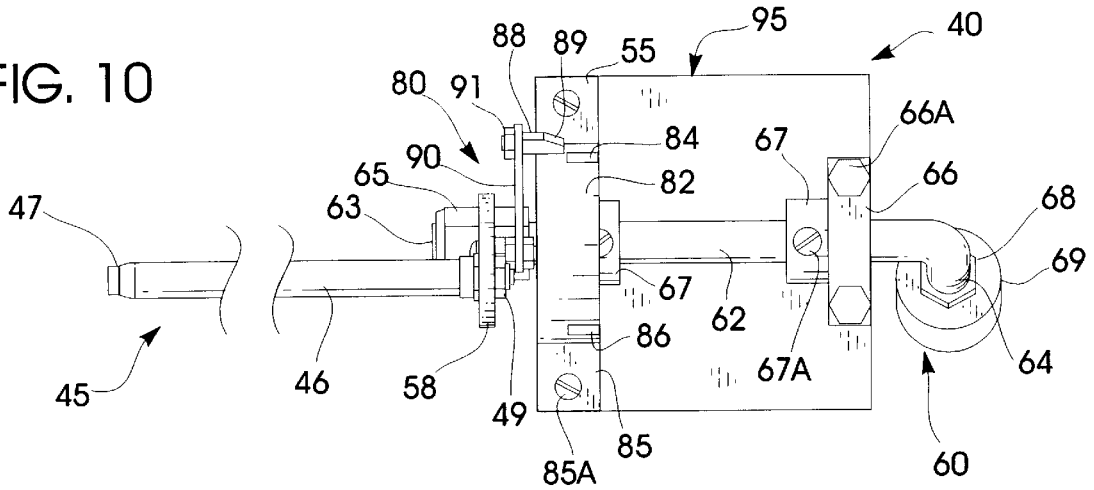
FIG. 10 is a front elevational view of the indicator assembly.
Figure 11:
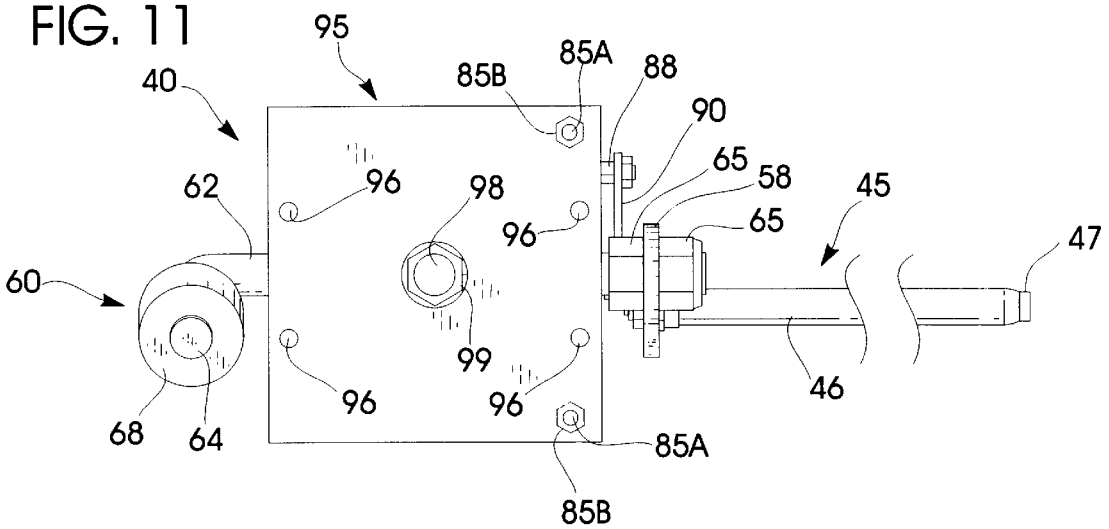
Figure 12:
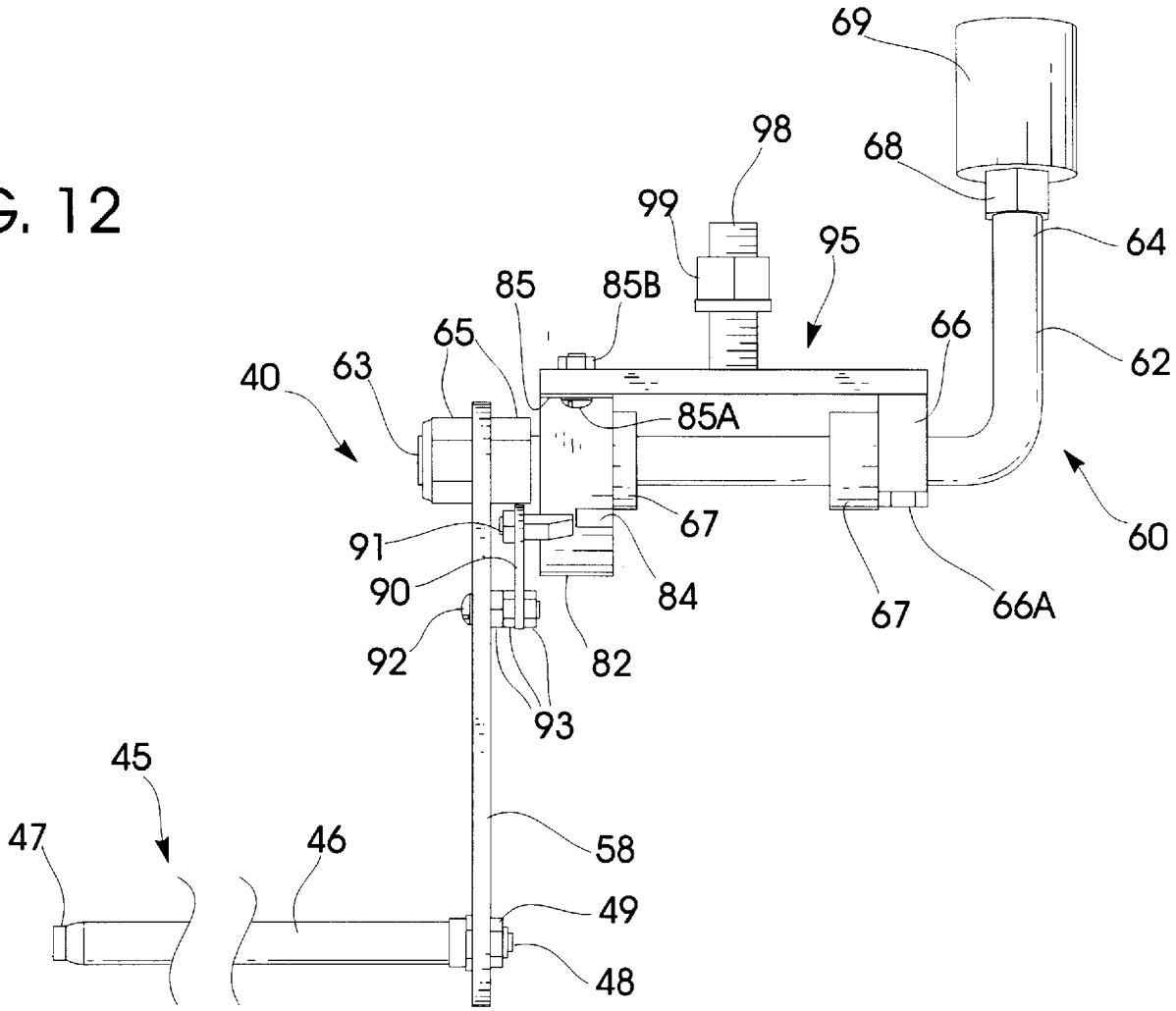
FIG. 12 is a top plan view of the indicator assembly.
Figure 13:
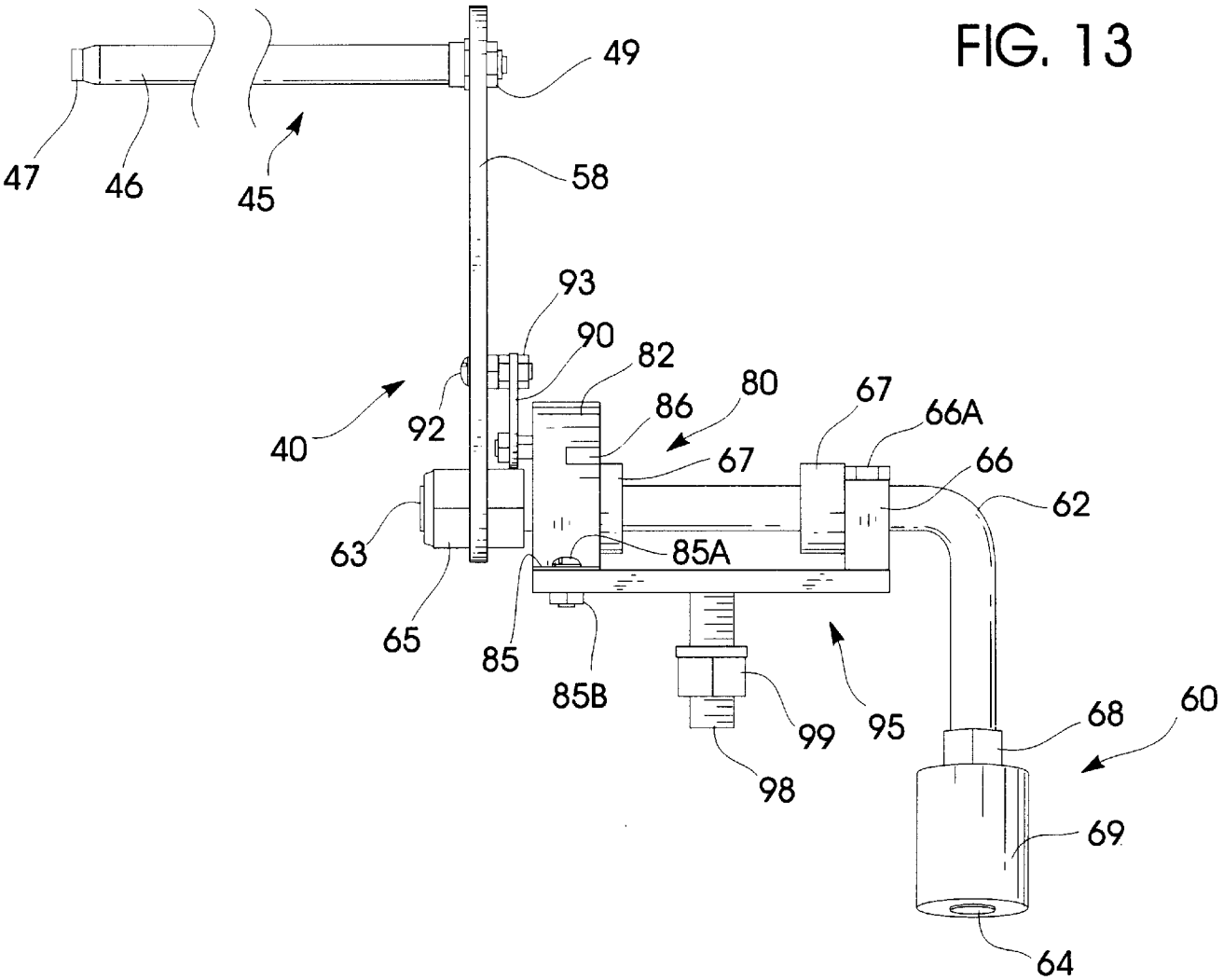
FIG. 13 is a bottom plan view of the indicator assembly.
Figure 14:
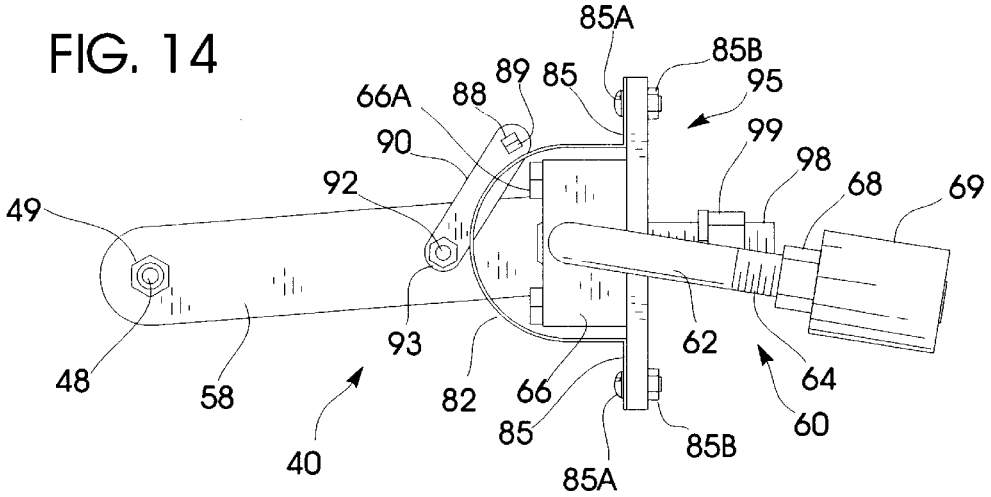
FIG. 14 is a side elevational view of the indicator assembly taken generally from the right of FIG. 10; and, FIG. 15 is a side elevational view of the indicator assembly taken generally from the left of FIG. 10.
Figure 15:
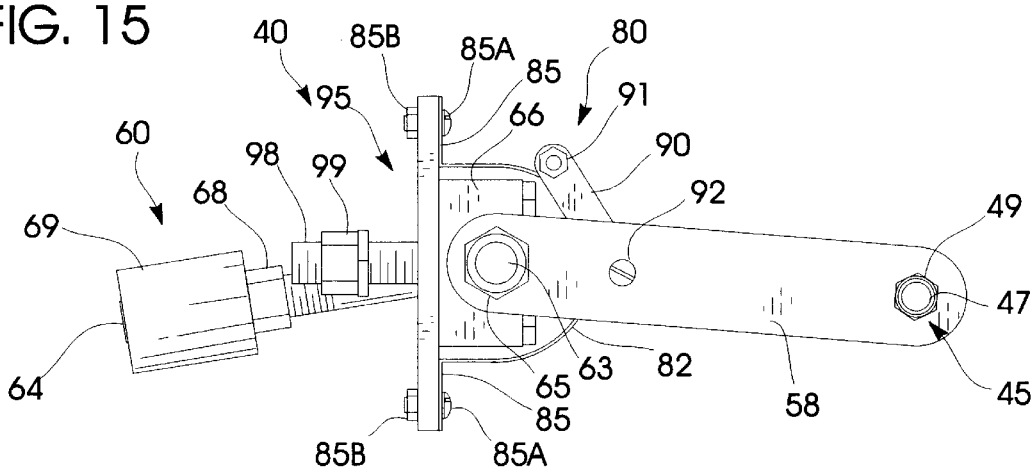

As can best be seen in FIG. 7, the indicator assembly 40 can be easily reversed and moved to the right side of the motor grader 25 by simply flipping the assembly over. As a result, linkage 58 moves along gauge 82 as indicated by arrow 190 while arm 90 must be rotated as indicated by arrow 195. Of course, either the mounting assembly 100 must be disconnected from blade 26 or another mounting assembly 100 must be installed on the right side of grader 25. If the mounting assembly 100 is moved as well, the standoff 120 must also be rotated 180 degrees.

In use, the operator watches pointer 88 to ensure that it remains aligned with marker 84 (or 86 if on the right side of the vehicle 25). If the probe moves upwardly or downwardly, the pointer moves along gauge 82 correspondingly and the operator must change the blade orientation until the pointer again returns to the marker 84. Thus, the system 20 permits the operator to quickly and efficiently establish desired grades during construction work.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A grade level indicator for operator driven construction vehicles used with reference guides, said indicator comprising:

a follower comprising a portion protruding beyond the vehicle periphery and running against the guide during vehicle movement;

a counterweight secured to said follower for keeping said follower protruding portion against the guide during vehicle movement;

a dial visible to the operator for indicating grade alignment;

a pointer protruding from said follower and registering on said dial, said pointer visible to the operator during vehicle movement, wherein said pointer is transformable between left and right mounted operation and said dial comprises a left marker and a right marker so that said indicator can be reversed; and, means for mounting said indicator on an active blade or tool of the vehicle controlled by an operator, said mounting means comprising an adjustable bracket attached to said blade or tool and a telescopic jack extending rearwardly from said bracket and adapted to support said indicator, said jack comprising quick adjustment means for moving said indicator upwardly or downwardly relative to said blade.

2. The indicator as defined in claim 1 wherein the reference guide is a conventional string line and said follower comprises an elongated probe adapted to move against the bottom of the string line during vehicle movement.

3. The indicator as defined in claim 1 wherein the reference guide is a hard surface adjacent the construction site and said follower comprises a wheel adapted to move over the surface during vehicle movement.

4. The indicator as defined in claim 1 wherein said counterweight is offset from said follower.

5. The indicator as defined in claim 4 wherein the axis of said counterweight forms a dampering angle with the axis of said follower that is between 3 and 6 degrees.

6. The indicator as defined in claim 5 wherein an elongated linkage couples said follower interior to said counterweight, said linkage permitting the variation of said dampening angle.

7. An alignment system for a motor grader that uses a conventional string line as a reference guide, said system comprising:

a follower comprising a probe protruding outwardly from the vehicle, said probe having a terminus adapted to run against the bottom of said string line during vehicle movement;

a counterweight secured to said follower and offset from said probe for keeping said follower against the guide during vehicle movement;

a pointer protruding from said follower and registering on a rotary dial, said pointer and said dial visible to the operator during vehicle movement, wherein said pointer is transformable between left and right mounted operation and said rotary dial comprises a left marker and a right marker so that said alignment system can be reversed; and, means for mounting said alignment system on an active blade or tool of the vehicle controlled by an operator, said mounting means comprising:

an adjustable bracket attached to said blade or tool;

a jack extending rearwardly from said bracket, said jack adapted to support said alignment system a preselected distance from the string line;

a plate coupled to said jack and rotatably supporting said counterweight; and, adjustment means on said jack for quickly moving said plate upwardly or downwardly relative to said blade.

8. The system as defined in claim 7 wherein the axis of said counterweight forms a dampening angle with the axis of said follower that is between 3 and 6 degrees.

9. The system as defined in claim 8 wherein an elongated linkage couples said probe to said counterweight, said linkage permitting the variation of said dampening angle.

10. An alignment system for a motor grader that uses a conventional string line as a reference guide, said system comprising:

a follower comprising a probe protruding outwardly from the vehicle, said probe having a terminus adapted to run against the bottom of said string line during vehicle movement;

a counterweight secured to said follower for keeping said follower against the guide during vehicle movement;

a rotatable pointer protruding from said follower and registering on a rotary dial, said pointer and said dial both visible to the operator during vehicle movement, said pointer rotating between left and right operation and said rotary dial comprising a left marker and a right marker so that said alignment system can be reversed; and, means for mounting said system on an active blade or tool of the vehicle controlled by an operator, said mounting means comprising:

an adjustable bracket attached to said blade or tool;

a jack extending rearwardly from said bracket, said jack adapted to support said probe a preselected distance beneath a the string line;

a plate coupled to said jack and rotatably supporting said counterweight; and, adjustment means on said jack for quickly moving said plate upwardly or downwardly relative to said blade.

11. The system as defined in claim 10 wherein said counterweight is offset from said follower.

12. The system as defined in claim 11 wherein the axis of said counterweight forms a dampening angle with the axis of said follower that is between 3 and 6 degrees.

13. The system as defined in claim 12 wherein an elongated linkage couples said probe to said counterweight, said linkage permitting the variation of said dampening angle.

* * * * *